US009562325B2

(12) United States Patent
Tanaka

(10) Patent No.: US 9,562,325 B2
(45) Date of Patent: Feb. 7, 2017

(54) SHEET MANUFACTURING APPARATUS AND SHEET MANUFACTURING METHOD

(71) Applicant: SEIKO EPSON CORPORATION, Tokyo (JP)

(72) Inventor: Hiroshi Tanaka, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 192 days.

(21) Appl. No.: 14/569,969

(22) Filed: Dec. 15, 2014

(65) Prior Publication Data

US 2015/0184341 A1 Jul. 2, 2015

(30) Foreign Application Priority Data

Dec. 27, 2013 (JP) ..... 2013-270766
Jan. 24, 2014 (JP) ..... 2014-011064

(51) Int. Cl.
*B27N 3/04* (2006.01)
*D21F 7/00* (2006.01)
*D04H 1/736* (2012.01)

(52) U.S. Cl.
CPC . *D21F 7/00* (2013.01); *B27N 3/04* (2013.01); *D04H 1/736* (2013.01)

(58) Field of Classification Search
CPC ..... D21F 7/00; D21F 7/06; D21F 9/00; D21B 1/08; D21B 1/06; G01N 21/47; B07B 1/00; D04H 1/00; D04H 1/732; D21C 5/02; D21H 11/14; F21V 14/006; G01J 1/4204; B27N 3/04
See application file for complete search history.

(56) References Cited

U.S. PATENT DOCUMENTS 4,289,964 A * 9/1981 Baker ..... G05D 5/03 250/308
5,071,514 A * 12/1991 Francis ..... D21F 7/06 162/259
8,421,036 B2 * 4/2013 Horii ..... B82Y 15/00 250/458.1
9,024,259 B2 * 5/2015 Jones ..... G01N 21/3563 250/338.1
9,315,941 B2 * 4/2016 Gomi ..... D21F 3/04
2009/0261269 A1 * 10/2009 Horii ..... B82Y 15/00 250/459.1
2010/0290032 A1 * 11/2010 Bugge ..... B07C 5/342 356/51
2014/0027075 A1 1/2014 Yamagami et al.
(Continued)

FOREIGN PATENT DOCUMENTS

EP 2110658 A1 * 10/2009 ..... B82Y 15/00
JP 2012-144819 A 8/2012
(Continued)

*Primary Examiner* — Jose Fortuna
(74) *Attorney, Agent, or Firm* — Global IP Counselors, LLP

(57) ABSTRACT

A sheet manufacturing apparatus includes a transfer path through which flows at least a portion of a material for a sheet in air and which has a curved section where the transfer path is curved, and a forming unit configured to form the sheet using the material, and an optical detecting unit configured to detect the material and provided at the curved section or at the transfer path more to a downstream side than the curved section in a material transfer direction.

9 Claims, 5 Drawing Sheets

(56) References Cited

U.S. PATENT DOCUMENTS

| | | | | |
|---|---|---|---|---|
| 2014/0290884 | A1* | 10/2014 | Yamagami | D21H 23/06 162/158 |
| 2014/0290889 | A1* | 10/2014 | Oguchi | B07B 1/00 162/259 |
| 2015/0138823 | A1* | 5/2015 | Corrigan | G01D 5/268 362/551 |
| 2015/0184341 | A1* | 7/2015 | Tanaka | D21F 7/00 162/252 |
| 2015/0275435 | A1* | 10/2015 | Seki | |
| 2016/0069023 | A1* | 3/2016 | Murayama | D04H 1/00 156/64 |
| 2016/0168794 | A1* | 6/2016 | Tsujino | D21F 7/06 162/198 |

FOREIGN PATENT DOCUMENTS

| | | | | |
|---|---|---|---|---|
| JP | 2016113721 | A1 * | 6/2016 | D21F 7/06 |
| JP | 20151273701 | A * | 7/2016 | D21F 7/00 |

* cited by examiner

SHEET MANUFACTURING APPARATUS AND SHEET MANUFACTURING METHOD

CROSS-REFERENCE TO RELATED APPLICATIONS

This application claims priority to Japanese Patent Application No. 2013-270766 filed on Dec. 27, 2013 and Japanese Patent Application No. 2014-011064 filed on Jan. 24, 2014. The entire disclosure of Japanese Patent Application Nos. 2013-270766 and 2014-011064 is hereby incorporated herein by reference.

BACKGROUND

Technical Field

The present invention relates to a sheet manufacturing apparatus and a sheet manufacturing method.

Related Art

In the prior art, there is known a paper recycling apparatus which has a dry-type defibrating unit which crushes and defibrates paper, a first transfer unit which transfers the defibrated material which is defibrated by the dry-type defibrating unit, a classifier unit which classifies using a flow of air and deinks the defibrated material which is transferred by the first transferring unit, a second transfer unit which transfers the defibrated material which is deinked by the classifier unit, and a paper forming unit which forms paper using the defibrated material which is transferred by the second transferring unit (for example, refer to Japanese Examined Patent Application Publication No. 2012-144819).

It is necessary in the apparatus described above that the amount of the defibrated material which is being transferred is constant in order to manufacture sheets with uniform thickness. However, since the defibrated material in the apparatus described above has a fibrous form and is extremely light, it is difficult to measure the transfer weight of the defibrated material. Accordingly, there are problems such that it is not possible to manage the transfer weight of the defibrated material which is being fed in and it is not possible to manufacturing, for example, sheets with uniform thickness.

SUMMARY

The present invention is carried out in order to solve a portion of the problems described above and is able to be realized as the following aspects and applied examples.

A sheet manufacturing apparatus according to the first aspect of the invention comprises a transfer path through which flows at least a portion of a material for a sheet in air and which has a curved section where the transfer path is curved, a forming unit configured to form the sheet using the material, and an optical detecting unit configured to detect the material and provided at the curved section or at the transfer path more to a downstream side than the curved section in a transfer direction in which the material is transferred.

According to this configuration, there is the curved section in the transfer path and the optical detecting unit which detects the material is provided at the curved section or at the transfer path more to the downstream side than the curved section in a material transfer direction. The transfer path transfers the material in air due to, for example, a flow of air or gravity. The material which is being transferred is transferred so as to be drawn together at one side of the transfer path due to centrifugal force at the curved section or at the transfer path more to the downstream side than the curved section in the material transfer direction. For this reason, it is possible to easily detect the presence or absence of the material using the optical detecting unit. Then, it is possible to easily manage, for example, the transfer weight of the material.

In the sheet manufacturing apparatus according to the aspect of the invention described above, light which is emitted from the optical detecting unit is transmitted through at least a portion of the transfer path.

According to this configuration, since light which is emitted from the optical detecting unit is transmitted through the transfer path, it is possible to reliably detect the presence or absence of the material.

The sheet manufacturing apparatus according to the aspect of the invention described above further comprises a defibrating unit configured to defibrate at least a portion of the material and an accumulating unit configured to accumulate the material. The transfer path is downstream of the defibrating unit in the transfer direction and is upstream of the accumulating unit in the transfer direction.

According to this configuration, since it is easy for the effects of centrifugal force to be received due to the relatively light weight of the material in fibrous form which passes through the defibrating unit and the material which includes an additive which is introduced before the accumulating section, it is possible to further effectively detect the presence or absence of the material.

The transfer path in the sheet manufacturing apparatus according to the aspect of the invention described above has linear sections on both sides of the curved section and an opening angle of the linear sections is 45 degrees or more and 150 degrees or less.

According to this configuration, it is possible for it to be easy for the material to be easily drawn together at one side of the transfer path due to centrifugal force.

A sheet manufacturing method according to the second aspect of the invention includes flowing at least a portion of a material for a sheet in a transfer path which has a curved section and detecting the material using an optical detecting unit which is arranged at the curved section or at the transfer path more to a downstream side than the curved section in a transfer direction in which the material is transferred.

According to this configuration, there is the curved section in the transfer path and the optical detecting unit is provided at the curved section or at the transfer path more to the downstream side than the curved section in a material transfer direction. The material which is being transferred is transferred so as to be drawn together at one side of the transfer path due to centrifugal force at the curved section or at the transfer path more to the downstream side than the curved section in the material transfer direction. For this reason, it is possible to easily detect the presence or absence of the material using the optical detecting unit. Then, it is possible to easily manage the transfer amount of the material by, for example, calculating the weight or the like of the material which flows through the transfer path.

Here, in a case of measuring using the optical detecting unit, there are problems such that detection accuracy of the optical detecting unit is reduced due to the defibrated material or the like becoming attached or the like in the transfer path as the apparatus is used and measurement errors are generated in the transfer weight of the defibrated material. It is possible for the present invention to be realized as the flowing aspects or applied examples so as to solve at least a portion of these problems.

A sheet manufacturing apparatus according to the third aspect of the invention comprises a transfer path through which flows at least a portion of a material for a sheet in air and a forming unit configured to form the sheet using the material, the transfer path has a transparent section through which light is transmitted, and an optical detecting unit which has a light emitting section configured to emit light with regard to the transparent section and a light receiving section configured to receive the light which passes through the transparent section. The sheet manufacturing apparatus further comprises a control section configured to determine that the material is not flowing through when the amount of light which is received by the light receiving section is larger than a threshold which is set in advance, and the threshold becomes smaller as the accumulated period of time over which the sheet manufacturing apparatus is used increases.

The material for the sheet is transferred in the transfer path due to the sheet manufacturing apparatus being used. At this time, a portion of the material which is being transferred becomes attached to the transparent section of the transfer path. In this case, the amount of the portion of material which becomes attached to the transparent section of the transfer path increases as the period of time over which the sheet manufacturing apparatus is used increases. Due to this, there is a reduction in the received light amount in the light receiving section which receives light which is emitted from the light emitting section in the optical detecting unit. On the other hand, the threshold for determining the presence or absence of the material in the transfer path is prescribed based on the received light amount in the light receiving section. That is, in a case where there is a reduction in the received light amount in the light receiving section due to the material becoming attached or the like, it is determined that the material is flowing through the flow path even in a case where material is not flowing through the transfer path since the threshold does not correspond to variation in the received light amount. Therefore, according to the configuration described above, the threshold is set to become smaller as the accumulated period of time over which the sheet manufacturing apparatus is used increases. That is, it is possible for the threshold to be more appropriately adjusted according to the accumulated period of time over which the sheet manufacturing apparatus is used. Due to this, it is possible to appropriately maintain the detection accuracy of the optical detecting unit and to reduce measurement errors in detection of the transfer weight of the defibrated material.

The control section of the sheet manufacturing apparatus according to the aspect of the invention described above is configured to reduce the threshold in a case where a received light amount in the light receiving section, when the light is emitted in a state where the material is not flowing through the sheet manufacturing apparatus, is small, as compared with in a case where the received light amount in the light receiving section is large when the light is emitted in the state.

According to the configuration described above, by the threshold being reduced as there is an increase in the reduction of the received light amount when light is emitted in a state where the material is not flowing through the sheet manufacturing apparatus, it is possible to suppress that the amount of light receives is below the threshold even though the material is not flowing through the transfer path and that the existence of the material is recognized.

The control section of the sheet manufacturing apparatus according to the aspect of the invention described above is configured to reduce the threshold in a case where the received light amount in the light receiving section, when the light is emitted in a state where the material is not flowing through the sheet manufacturing apparatus, is smaller than the received light amount when starting to use the sheet manufacturing apparatus.

According to the configuration described above, the received light amount is large when starting to use the sheet manufacturing apparatus since the material is not attached in the transfer path. The received light amount is reduced as the material becomes attached to the transparent section of the transfer path when the sheet manufacturing is being used. Therefore, by the threshold being reduced in a case of the received light amount being less than the received light amount when starting to use the sheet manufacturing apparatus, it is possible to suppress that the amount of light receives is below the threshold even though the material is not flowing through the transfer path and that the existence of the material is recognized.

In a sheet manufacturing method according to the fourth aspect of the invention, a sheet is manufactured using a sheet manufacturing apparatus which includes a transfer path through which flows at least a portion of a material for the sheet in air, and a forming unit configured to form the sheet using the material, and the transfer path is provided with a transparent section where light is transmitted, and an optical detecting unit which has a light emitting section configured to emit the light with regard to the transparent section and a light receiving section configured to receive light which passes through the transparent section. The method comprises reducing a threshold, in a case of determining that the material is not flowing through when an amount of light which is received by the receiving section is larger than the threshold which is set in advance, as the accumulated period of time over which the sheet manufacturing apparatus is used increases.

The material for the sheet is transferred in the transfer path due to the sheet manufacturing apparatus being used. At this time, a portion of the material which is being transferred becomes attached to the transparent section of the transfer path. In this case, the amount of the material which becomes attached to the transparent section of the transfer path increases as the period of time over which the sheet manufacturing apparatus is used increases. Due to this, there is a reduction in the received light amount in the light receiving section which receives light which is emitted from the light emitting section in the optical detecting unit. On the other hand, the threshold for determining the presence of absence of the material in the transfer path is prescribed based on the received light amount in the light receiving section. That is, in a case where there is a reduction in the received light amount in the light receiving section due to the material becoming attached or the like, it is determined that the material is flowing through the flow path even in a case where material is not flowing through the transfer path since the threshold does not correspond to variation in the received light amount. Therefore, according to the configuration described above, the threshold is set to become smaller as the accumulated period of time over which the sheet manufacturing apparatus is used increases. That is, it is possible for the threshold to be appropriately adjusted according to the accumulated period of time over which the sheet manufacturing apparatus is used. Due to this, it is possible to appropriately maintain the detection accuracy of the optical detecting unit and to reduce measurement errors in detection of the transfer weight of the defibrated material.

BRIEF DESCRIPTION OF THE DRAWINGS

Referring now to the attached drawings which form a part of this original disclosure.

DETAILED DESCRIPTION OF EXEMPLARY EMBODIMENTS

An embodiment of the present invention will be described below with reference to the drawings. Here, the dimensions of each member and the like are shown as different to the actual dimensions in each of the following diagrams in order for each member and the like to be a size which is visually recognizable.

First, a configuration of a sheet manufacturing apparatus will be described. The sheet manufacturing apparatus is based on a technique where, for example, a raw material (material to be defibrated) Pu such as a fresh pulp sheet or used paper is formed into a new sheet Pr. The sheet manufacturing apparatus according to the present embodiment is provided with a transfer path through which flows at least a portion of a material for sheets in air and a forming unit which forms the sheets using the material, where the transfer path has a curved section where the transfer path is curved and an optical detecting unit which detects the material is provided in the transfer path more to the downstream side than the curved section in the material transfer direction. In addition, a sheet manufacturing method according to the present embodiment includes flowing at least a portion of a material for sheets in a transfer path which has a curved section and detecting the material using an optical detecting unit which is arranged in the transfer path more to the downstream side than the curved section in the material transfer direction. The configuration of the sheet manufacturing apparatus will be described in detail below.

Figure 1:
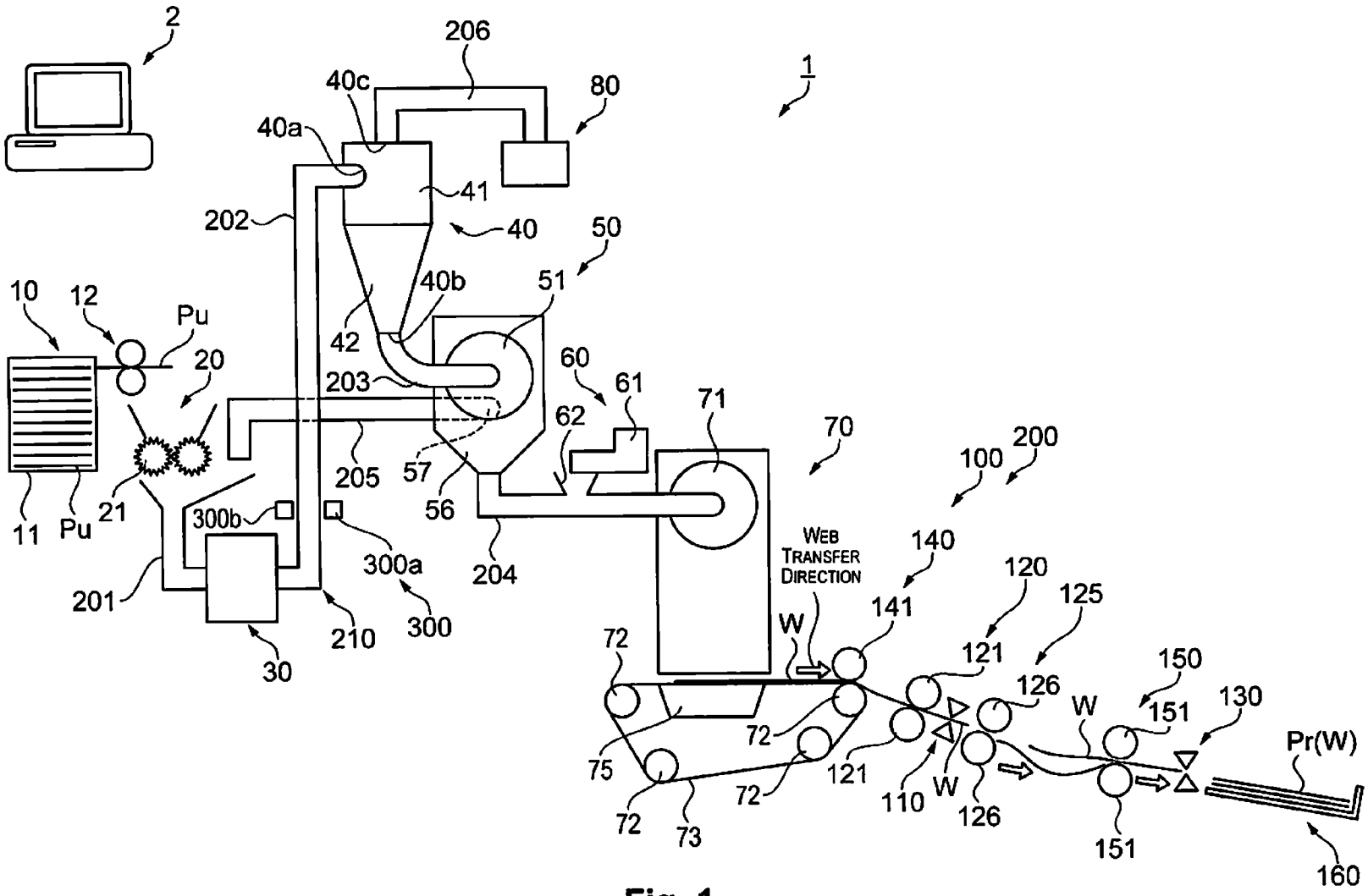
FIG. 1 is a schematic diagram illustrating a configuration of a sheet manufacturing apparatus.

FIG. 1 is a schematic diagram illustrating the configuration of the sheet manufacturing apparatus according to the present embodiment. As shown in FIG. 1, a sheet manufacturing apparatus 1 according to the present embodiment is provided with a supplying unit 10, a crushing unit 20, a defibrating unit 30, a classifier unit 40, a screening unit 50, an additive agent feeding unit 60, an accumulating unit 70, a forming unit 200, transfer paths 201, 202, and 203, an optical detecting unit 300, and the like. Then, a control section 2 which controls these members is provided.

The supplying unit 10 supplies the used paper Pu to the crushing unit 20. The supplying unit 10 is provided with, for example, a tray 11 where a plurality of sheets of the used paper Pu are stacked and held, an automatic sending mechanism 12 where it is possible for the used paper Pu in the tray 11 to be continuously fed into the crushing unit 20. As the used paper Pu which is supplied to the sheet manufacturing apparatus 1, there is, for example, sheets of A4 size paper and the like which is currently in mainstream use in offices.

The crushing unit 20 cuts the used paper Pu which is supplied into pieces of paper which are squares of several centimeters. A crushing blade 21 is provided in the crushing unit 20 and the apparatus is configured such that the cutting width of the blade of a normal shedder is widened. Due to this, it is possible to easily cut the used paper Pu which is supplied into pieces of paper. Then, the crushed paper which is cut up is supplied to the defibrating unit 30 via the transfer path 201.

The defibrating unit 30 is provided with a rotating blade which rotates (which is not shown in the diagram) and performs defibrating where the crushed paper which is supplied from the crushing unit 20 is disentangled into a fibrous state. Here, the defibrating unit 30 of the present embodiment performs defibrating in air with a dry type. Due to the defibrating process using the defibrating unit 30, paper coating materials such as printing ink or toner or a stain preventing material are separated from the fibers to become particles of several tens of μm or less (referred to below as "ink particles"). Accordingly, the defibrated material which is output from the defibrating unit 30 is fibers and ink particles which are obtained due to defibrating the pieces of paper. Then, there is a mechanism where a flow of air is generated by the rotation of the rotating blade and fibers which are defibrated are transferred in air to the classifier unit 40 via the transfer path 202 due to being caught by the flow of air. Here, an air flow generating apparatus, which generates a flow of air for transferring the material which is defibrated in the defibrating unit 30 to the classifier unit 40 via the transfer path 202, is separately provided according to requirements.

The classifier unit 40 classifies the introduced material which is introduced using the flow of air. In the present embodiment, the defibrated material which is the introduced material is classified into ink particles and fibers. Due to, for example, a cyclone being applied as the classifier unit 40, it is possible for the fibers which are being transferred to be classified using the flow of air into ink particles and deinked fibers (deinked defibrated material). Here, another type of classifier device with an air flow system may be used instead of the cyclone. In this case, for example, an elbow jet, an eddy classifier, or the like may be used as the classifier device with an air flow system other than the cyclone. By the classifier device with an air flow system generating a revolving flow of air and separating and classifying using differences in centrifugal force which is received according to the size and density of the defibrated material, it is possible to adjust the classifying points by adjusting the speed or centrifugal force of the flow of air. Due to this, ink particles which are comparatively small and have a low density and fibers which are larger and have a higher density than ink particles are divided up. Removing of ink particles from fibers is referred to as deinking.

The classifier unit 40 of the present embodiment is a tangential input type of cyclone and is configured from an introduction port 40*a* with introduction from the defibrating unit 30, a cylindrical unit 41 which is joined to the introduction port 40*a* in the tangential direction, a conical unit 42 which is continuous with a lower section of the cylindrical unit 41, a lower output unit 40*b* which is provided at a lower section of the conical unit 42, and an upper exhaust port 40*c* for discharging fine particles which is provided in the center of an upper section of the cylindrical unit 41. The diameter of the conical unit 42 becomes smaller heading downward in the vertical direction.

In the classifying process, the flow of air, which catches the defibrated material which is introduced from the introduction port 40*a* of the classifier unit 40, is changed to a circular action by the cylindrical unit 41 and the conical unit 42 and there is classifying due to centrifugal force being applied. Then, the deinking progressed by the fibers which are larger and have a higher density than ink particles being moved to the lower output unit 40*b* and the ink particles which are comparatively small and have a low density being introduced into the upper exhaust port 40*c* as fine particles along with the flow of air. Then, a mixture of short fibers, which includes a large amount of ink particles, is discharged from the upper exhaust port 40*c* of the classifier unit 40. Then, the mixture of short fibers, which is discharged and which includes a large amount of ink particles, is recovered by a receiving unit 80 via a transfer path 206 which is connected with the upper exhaust port 40*c* of the classifier unit 40. On the other hand, classified material which includes fibers which are classified is transferred in air from the lower output unit 40*b* of the classifier unit 40 to the screening unit 50 via the transfer path 203. Transferring from the classifier unit 40 to the screening unit 50 may be carried out using the flow of air when classifying or transferring from the classifier unit 40 which is above to the screening unit 50 which is below may be carried out using gravity. Here, a suction unit or the like for efficiently sucking in the mixture of short fibers from the upper exhaust port 40*c* may be arranged in the upper exhaust port 40*c* of the classifier unit 40, the transfer path 206, or the like.

The screening unit 50 screens the classified material which includes fibers which are classified using the classifier unit 40 by passing the classified material through a selecting drum 51 which has a plurality of openings. Furthermore, in detail, the classified material which includes fibers which are classified using the classifier unit 40 are screened into passing-through material which passes through the openings and residue material which does not pass through the openings. The screening unit 50 of the present embodiment is provided with a mechanism which disperses the classified material into air using a rotation operation. Then, the passing-through material which passes through the openings in the screening by the screening unit 50 is received by a hopper unit 56 and is transferred to the accumulating unit 70 via a transfer path 204. On the other hand, the residue material which does not pass through the openings in the screening by the screening unit 50 is returned to the defibrating unit 30 again as material to be defibrated via a transfer path 205 which is a returning path from a discharge unit 57. Due to this, the residue material is reused without being discarded.

The passing-through material which passes through the openings in the screening by the screening unit 50 is transferred in air to the accumulating unit 70 via the transfer path 204. Transferring from the screening unit 50 to the accumulating unit 70 may be carried out using a blower (which is not shown in the diagrams) which generates a flow of air or transferring from the screening unit 50 which is above to the accumulating unit 70 which is below may be carried out using gravity. An additive agent feeding unit 60, which adds additive agents such as resins (for example, a fusion-bondable resin or a thermosetting resin) with regard to the passing-through material which is being transferred, is provided between the screening unit 50 and the accumulating unit 70 in the transfer path 204. Here, it is possible for, for example, a fire retarding agent, a whitening agent, a sheet strength reinforcing agent, a sizing agent, and the like to be fed in as an additive agent along with fusion-bondable resins. These additive agents are retained in an additive agent retaining unit 61 and are fed in from a feeding port 62 using a feeding mechanism which is not shown in the diagrams.

The accumulating unit 70 forms a web W by accumulating using a material which includes the passing-through material and the resin which are fed in from the transfer path 204. The web forming unit 70 has a mechanism which uniformly disperses fibers in air and a mechanism which accumulates the fibers which are dispersed on a mesh belt 73. Here, the web W according to the present embodiment refers to a configuration format of a solid which includes fibers and resin. Accordingly, the web W is seen as a web even in cases where the format such as dimensions changes when heating, pressurizing, cutting, transferring, or the like.

First, a forming drum 71, where fibers and resin are feed into an inner section of the forming drum 71, is arranged in the accumulating unit 70 as the mechanism which uniformly disperses fibers in air. Then, it is possible to uniformly mix the resin (the additive agents) into the passing-through material (the fibers) by the forming drum 71 being driven to rotate. A screen which has a plurality of small holes is provided on the surface of the forming drum 71. Then, it is possible to uniformly disperse the fibers which pass through the small holes and the mixture of fibers and resin in air while uniformly mixing the resin (the additive agents) in the passing-through material (the fibers) by the forming drum 71 being driven to rotate.

An endless mesh belt 73, where a mesh which is stretched by stretching rollers 72 is formed, is arranged below the forming drum 71. Then, the mesh belt 73 moves in one direction due to driving of at least one of the stretching rollers 72.

In addition, a suction apparatus 75, which is a suction unit which generates a flow of air vertically downward through the mesh belt 73, is provided vertically below the forming drum 71. Using the suction apparatus 75, it is possible to suck the fibers which are dispersed in air onto the mesh belt 73.

Then, the fibers and the like, which pass through the screen with small holes in the forming drum 71, are accumulated on the mesh belt 73 using suction force from the suction apparatus 75. At this time, it is possible to form the web W where fibers and resin are included and accumulated with a lengthwise shape due to the mesh belt 73 being moved in one direction. The web W is formed with a continuous strip shape by dispersing from the forming drum 71 and moving the mesh belt 73 being continuously performed. Here, the mesh belt 73 may be made of metal, resin, or nonwoven material and the mesh belt 73 may be any type of mesh as long as it is possible for fibers to be accumulated and a flow of air to pass through. Here, fibers enter in between the mesh and there are irregularities when the web (the sheet) is formed if the diameter of the holes in the mesh of the mesh belt 73 is too large, and on the other hand, it is difficult to form a stable flow of air using the suction apparatus 75 if the diameter of the holes in the mesh are too small. For this reason, it is preferable for the diameter of the holes in the mesh to be appropriately adjusted. It is possible to configure the suction apparatus 75 so that a closed box is formed with a window with a desired size opened below the mesh belt 73, air is sucked in from a location other than the window, and there is a negative pressure in the box compared to the outside air. Here, the web W according to the present embodiment refers to a configuration format of a solid which includes fibers and resin. Accordingly, the web W is seen as a web even in cases where the format such as dimensions changes when heating, pressurizing, cutting, transferring, or the like.

The web W which is formed on the mesh belt 73 is transferred using the transferring unit 100. The transferring unit 100 in the present embodiment performs a transfer process for the web W from the mesh belt 73 until a sheet Pr (the web W) is finally feed into a stacker 160. Accordingly, various types of rollers and the like function as a portion of the transferring unit 100 along with the mesh belt 73. It is sufficient if there is at least one of a transfer belt, a transfer roller, or the like as the transfer unit. In detail, first, the web W, which is formed on the mesh belt 73 which is a portion of the transferring unit 100, is transferred according to the transfer direction (the arrows in the diagram) due to the mesh belt 73 being driven to rotate. Next, the web W is transferred from the mesh belt 73 according to the transfer direction (the arrows in the diagram). Here, the accumulating unit 70 and the transferring unit 100 in the present embodiment are a portion of the forming unit 200 which forms the sheet Pr using the web W.

A pressurizing unit is arranged on the downstream side of the accumulating unit 70 in the transfer direction of the web W. Here, the pressurizing unit in the present embodiment is a pressurizing unit 140 which has a roller 141 which pressurize the web W. It is possible to pressurize the web W by passing the web W between the rollers 141 and a stretching roller 72. Due to this, it is possible to improve the strength of the web W.

A pre-cutting unit roller 120 is arranged on the downstream side of the pressurizing unit 140 in the transport direction of the web W. The pre-cutting unit roller 120 has a pair of rollers 121. Out of the pair of rollers 121, one of the rollers 121 is a driving control roller and the other of the rollers 121 is a driven roller.

In addition, a one-way clutch is used in a driving transmission unit which rotates the pre-cutting unit roller 120. The one-way clutch has a clutch mechanism which transmits rotational force only in one direction and is configured so as to spin freely in the reverse direction. Due to this, it is possible to suppress tension on the web W and to prevent the web W being pulled and torn since the pre-cutting unit roller 120 spins freely when excessive tension is applied to the web W due to differences in speed between a post-cutting unit roller 125 and the pre-cutting unit roller 120.

A cutting unit 110, which cuts the web W in a direction which intersects with the transfer direction of the web W which is being transferred, is arranged on the downstream side of the pre-cutting unit roller 120 in the transfer direction of the web W. The cutting unit 110 is provided with a cutter and cuts the web W with a continuous shape into sheet shapes according to a cutting position which is set to a predetermined length. It is possible for, for example, a rotary cutter to be applied as the cutting unit 110. Due to this, cutting is possible while the web W is being transferred. Accordingly, it is possible to improve manufacturing efficiency since transferring of the web W is not stopped during cutting. Here, various types of cutters other than a rotary cutter may be applied as the cutting unit 110.

The post-cutting unit roller 125 is arranged on the downstream side of the cutting unit 110 in the transfer direction of the web W. The post-cutting unit roller 125 has a pair of rollers 126. Out of the pair of rollers 126, one of the rollers 126 is a driving control roller and the other of the rollers 126 is a driven roller.

In the present embodiment, it is possible to apply tension to the web W due to differences in speed between the pre-cutting unit roller 120 and the post-cutting unit roller 125. Then, there is a configuration where the web W is cut by the cutting section 110 being driven in a state where tension is applied to the web W.

A pair of heating and pressurizing rollers 151 which configure a heating and pressurizing unit 150 are arranged on the downstream side of the post-cutting unit roller 125 in the transfer direction of the web W. The heating and pressurizing unit 150 bonds (fixes) together the fibers which are included in the web W via the resin. A heating means such as a heater is provided at a center section of the rotation shaft of the heating and pressurizing rollers 151 and it is possible to heat and pressurize the web W which is being transferred by the web W being passed between the pair of heating and pressurizing rollers 151. Then, it is easy for the resin to melt and the fibers to become entangled as well as for the gaps between fibers to be shorter and the points of contact between fibers to be increased by heating and pressurizing the web W using the pairs of heating and pressurizing rollers 151. Due to this, the strength of the web W is improved by increasing the density.

A rear cutting unit 130 which cuts the web W along the transfer direction of the web W is arranged on the downstream side of the heating and pressurizing unit 150 in the transfer direction of the web W. The rear cutting unit 130 is provided with a cutter and cuts according to a predetermined cutting position in the transfer direction of the web W. Due to this, the sheet Pr (the web W) is formed with the desired size. Then, the sheet Pr (the web W) which is cut is stacked in the stacker 160 or the like.

Here, the sheet according to the present embodiment is mainly referred to as a sheet with a sheet shape where the raw material includes fibers such as used paper or fresh pulp. However, the sheet is not limited to this and may be a board shape or a web shape (or a shape with irregularities). In addition, the sheet may be use plant fibers such as cellulose, chemical fibers such as PET (polyethylene-telephthalate) or polyester, or animal fibers such as wool or silk as raw materials. The sheet in the present application can be divided into paper or nonwoven material. Paper includes formats such as thin sheet shapes and includes recording paper, wall paper, wrapping paper, colored paper, drawing paper, and the like with the aim of writing or printing. Nonwoven material includes nonwoven material, fiber board, tissue paper, kitchen paper, cleaning paper, filters, liquid absorbing materials, sound absorbing bodies, shock absorbing materials, mats, and the like with greater thickness and lower strength compared to paper.

In addition, used paper in the present embodiment described above indicates paper which is mainly used for printing but any paper which is formed as paper is a raw material and can be seen as used paper irrespective whether or not it has been used.

Figure 2A:
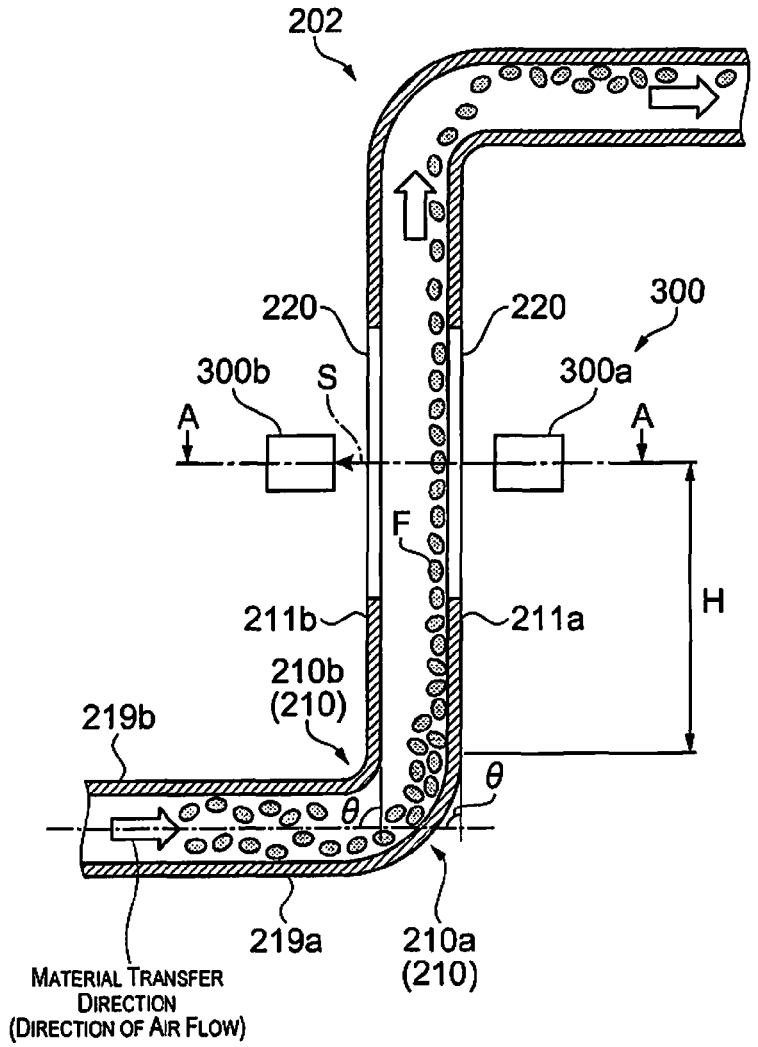
FIGS. 2A and 2B are schematic diagrams illustrating a configuration of an optical detecting unit and peripheral units.
Figure 2B:
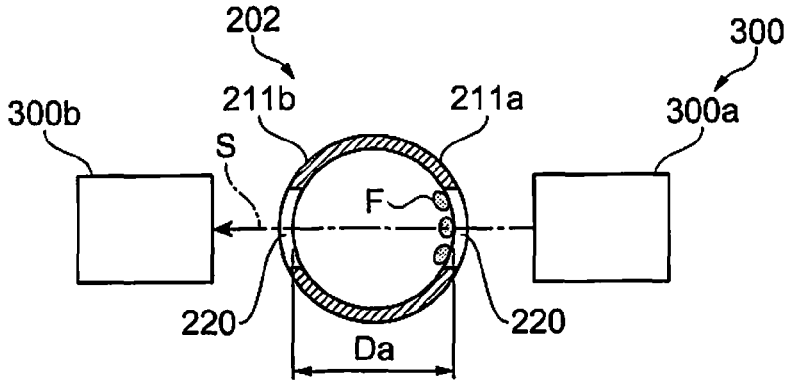

A configuration of the optical detecting unit and peripheral units of the sheet manufacturing apparatus will be described next. FIGS. 2A and 2B illustrate a configuration of the optical detecting unit and the peripheral units, FIG. 2A is a side cross section, and FIG. 2B is a cross section of A-A in FIG. 2A. Here, it is sufficient if the transfer path is downstream of the defibrating unit 30 in the transfer direction and upstream of the accumulating unit 70 in the transfer direction but the transfer path is not limited to this. Here, the transfer path 202 which connects the defibrating unit 30 and the classifier unit 40 is described as an example in the present embodiment.

As shown in FIG. 2A, the transfer path 202 has curved sections 210 (210*a* and 210*b*) where the transfer path 202 is curved. In the present embodiment, the transfer path 202 has horizontal sections 219*a* and 219*b* which are arranged in the horizontal direction on the upstream side in the material transfer direction as shown in a cross sectional view in FIGS. 2A and 2B. Then, the curved sections 210*a* and 210*b* link with the horizontal sections 219*a* and 219*b*. There are linear sections 211*a* and 211*b* which are linked with the curved sections 210 at the downstream side of the curved sections 210*a* and 210*b* in the material transfer direction. An opening angle θ of the linear sections 211*a* and 211*b* with regard to the horizontal sections 219*a* and 219*b* is 45 degrees or more and 150 degrees or less. Here, the opening angle θ in the present embodiment is set to be approximately 90 degrees. Due to the transfer path 202 being configured in this manner, the material, which is being transferred using a flow of air from the upstream side of the curved sections 210 in the material transfer direction, is transferred to one side of the transfer path 202 due to centrifugal force in the transfer path on the downstream side of the curved sections 210, that is, is transferred to be drawn together at the side of a portion of the curved section 210*a* and the linear section 211*a*.

The optical detecting unit 300 is arranged at an intermediate position in the linear section 211*a* after the curved sections 210 in the transfer path 202 in the material transfer direction. The optical detecting unit 300 in the present embodiment detects the presence or absence of the material which is flowing through the transfer path 202. The arrangement position of the optical detecting unit 300 is set so that a distance H from a connecting section of the linear section 211*a* and the curved sections 210 to an optical axis S of the optical detecting unit 300 is, for example, within nine times of the inner diameter of the transfer path 202. When the distance H exceeds nine times of the inner diameter of the transfer path 202, there are cases where the effect of the centrifugal force is reduced and the material is not drawn together at the one side of the transfer path 202. Due to the distance H being within nine times of the inner diameter of the transfer path 202, detection accuracy is improved since it is possible to reliably detect at where the material is drawn together. The distance H may be within 600 mm. Then, the optical detecting unit 300 in the present embodiment is arranged at a position which corresponds to the linear sections 211*a* and 211*b* in the transfer path 202.

The optical detecting unit 300 is provided with a light emitting section 300*a* which emits light and a light receiving section 300*b* which receives light which is emitted from the light emitting section 300*a*. Then, the light emitting section 300*a* and the light receiving section 300*b* are arranged via the transfer path 202 so that the optical axis S of the light emitting section 300*a* and the light receiving section 300*b* is in a perpendicular direction with regard to the linear sections 211*a* and 211*b*. The light emitting section 300*a* is, for example, a light emitting diode (LED) light emitting element, a laser light emitting element, or the like. The optical detecting unit 300 is connected to a control section and is controlled to be driven based on a predetermined program. Here, in the present embodiment, the light emitting section 300*a* is arranged on the linear section 211*a* side, that is, at the side where the material is transferred and drawn together, and the light receiving section 300*b* is arranged at the linear section 211*b* side which is the opposite side, but the configuration is not limited to this. For example, the light receiving section 300*b* may be arranged on the linear section 211*a* side and the light emitting section 300*a* may be arranged at the linear section 211*b* side which is the opposite side.

In addition, at least a portion of the transfer path 202 which corresponds to the optical axis S of the light emitting section 300*a* and the light receiving section 300*b* of the optical detecting unit 300 is configured so that light is transmitted. Due to this, it is possible for light which is emitted from the light emitting section 300*a* of the optical detecting unit 300 to be received by the light receiving section 300*b*. In the present embodiment, a transparent member 220 which has transmissivity is arranged in a portion of the linear sections 211*a* and 211*b* in the transfer path 202. Here, it is sufficient if the transparent member 220 is provide at least on the optical axis S of the light emitting section 300*a* and the light receiving section 300*b*, and the transparent member 220 may be arranged over a portion or the entirety of the transfer path 202 in the circumferential direction.

In addition, as shown in FIG. 2B, the light emitting section 300*a* and the light receiving section 300*b* are arranged so that the optical axis S of the light emitting section 300*a* and the light receiving section 300*b* passes through an inner section of the transfer path 202. Here, in the present embodiment, the light emitting section 300*a* and the light receiving section 300*b* are arranged at a position where the optical axis S of the light emitting section 300*a* and the light receiving section 300*b* passes through a portion where material F is drawn together the most due to centrifugal force. In a case where there is the material F when the material F is being transferred in the transfer path 202 using a flow of air, the material F passes through farthest to the right in the inner section of the transfer path 202 due to centrifugal force in the FIG. 2B. It is possible to always detect the material F if there is the material F since the optical axis S passes through the portion where the material F is drawn together the most and it is possible to accurately detect the presence or absence of the material.

Figure 3:
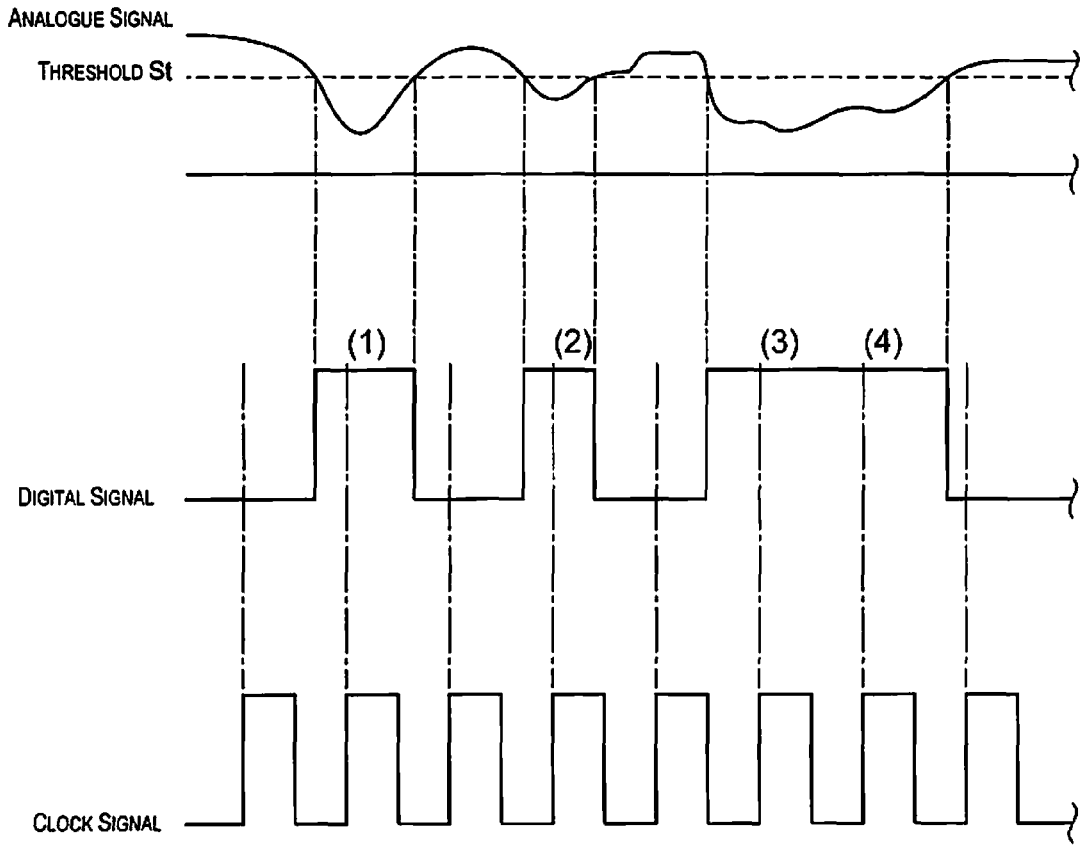
FIG. 3 is an explanatory diagram illustrating a method for operating a sheet manufacturing apparatus.

Next, a method for operating the sheet manufacturing apparatus will be described using FIGS. 2A and 2B and FIG. 3. FIG. 3 is an explanatory diagram illustrating a method for operating the sheet manufacturing apparatus. Here, a method for detecting the presence or absence of the material, which is being transferred in the transfer path of the sheet manufacturing apparatus, using the optical detecting unit will be described in detail in the present embodiment.

First, the material F (the defibrated material) which is defibrated using the defibrating unit 30 passes through the transfer path 202 using a flow of air which is generated by the defibrating unit 30 and is transferred to the classifier unit 40 side. Then, the material F passes through the horizontal sections 219*a* and 219*b* of the transfer path 202 when being transferred from the defibrating unit 30 to the classifier unit 40. The material F at this time is transferred by being completely scattered within the transfer path 202 as shown in FIG. 2A.

Next, the material F passes through the curved sections 210*a* and 210*b* of the transfer path 202. The curved sections 210*a* and 210*b* is a portion where the material F is transferred from the horizontal sections 219*a* and 219*b* to the linear section 211*a* and 211*b*. The material F at this time is pulled toward one side of the curved section 210*a* side (the outer circumference side of the curved sections 210) due to centrifugal force at the curved sections 210.

Next, the material F passes through the linear sections 211*a* and 211*b* of the transfer path 202. The material F at this time is transferred with the material which is transferred using a flow of air being drawn together at the one side of the linear section 211*a* side due to centrifugal force. Then, the presence or absence of the material F, which is being transferred to be drawn together at the linear section 211*a* side, is detected using the optical detecting unit 300. As the method for detecting, light is generated from the light emitting section 300*a* of the optical detecting unit 300 and the light which is generated is received using the light receiving section 300*b*. At this time, when the material F passes between the light emitting section 300*a* and the light receiving section 300*b*, the light from the light emitting section 300*a* is blocked by the material F and the amount of light which is received by the light receiving section 300*b* is reduced. That is, a state of the material F not being transferred is indicated by a case where the light is generated from the light emitting section 300*a* and there is a large received light amount in the light receiving section 300*b* which receives the light which is generated. On the other hand, a state of the material F being transferred is indicated by a case where the light from the light emitting section 300*a* is blocked by the material F and the amount of light which is received by the light receiving section 300*b* is reduced. Due to this, it is possible to detect the presence or absence of the material F.

Furthermore, in detail, the received light amount in the light receiving section 300*b* (an analogue signal) which receives light from the light emitting section 300*a* is acquired as shown in FIG. 3. A digital signal is generated which is OFF in a case where the received light amount is larger than a threshold St and is ON in a case where the received light amount is smaller than the threshold St based on the acquired received light amount. Then, a clock signal with a predetermined cycle (for example, 10 ms) is generated and the number of ON digital signals is counted when the clock signal is rising. Then, the number of ON digital signals is counted within a predetermined period of time (for example, 20 seconds). In this manner, by determining a relationship expression between the number of ON signals which are counted (a count number) and the actual weight of the material which is being transferred, the transfer weight of the material F is calculated using the count number. Due to this, it is possible to manage the transfer weight of the material F which is being transferred and the transferring of a constant amount of the material is possible. Then, in a case where, for example, the count number is prescribed within the predetermined period of time and the count number which is detected is less than the prescribed count number, it is possible for an operator or the like to be warned that the feeding of raw material is low using a display, an alarm, or the like. In addition, in a case where the count number which is detected is larger than the prescribed count number, it is possible for an operator or the like to be warned that the basis weight (grammage) of the material to be defibrated Pu is too large compared to the prescribed value. If the count number is zero, it is possible to detect that raw materials have not been fed in.

Then, the material F which is transferred to the linear sections 211*a* and 211*b* is fed into the classifier unit 40 and is classified. After this, the sheet Pr is manufacturing via the accumulating section 70, the forming unit 200, and the like.

Figure 4A:
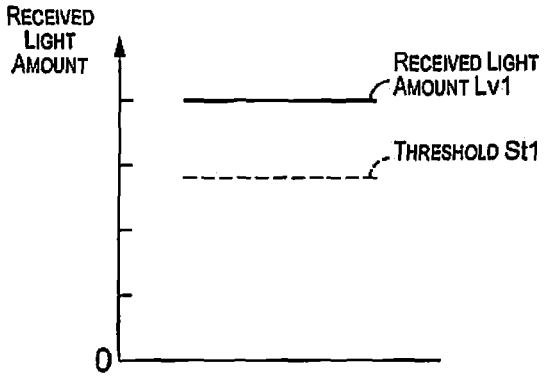
FIGS. 4A and 4B are explanatory diagrams illustrating a method for setting a threshold in an optical detecting unit.
Figure 4B:
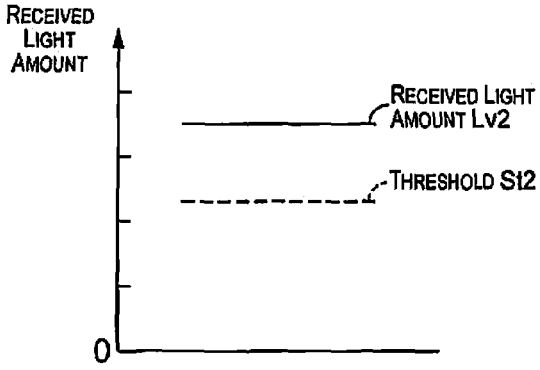

A method for setting the threshold in the optical detecting unit will be described next. FIGS. 4A and 4B are explanatory diagrams illustrating a method for setting the threshold in the optical detecting unit. As described above, the presence or absence of the material which is being transferred in the transfer path 202 of the sheet manufacturing apparatus 1 is detected using the optical detecting unit 300 but the amount of the portion of material which is attached to the transparent member 220 of the transfer path 202 increases as the period of time over which the sheet manufacturing apparatus 1 is used increases. Due to this, there is a reduction in the received light amount in the light receiving section 300*b* which receives light which is emitted from the light emitting section 300*a* in the optical detecting unit 300. On the other hand, there is a concern that it will be determined that the material is flowing through the transfer path 202 even in cases where the material is not flowing through the transfer path 202 if the threshold is not changed irrespective of changes in the received light amount due to the material becoming attached or the like.

Therefore, there is a control section 2 in the sheet manufacturing apparatus 1 of the present embodiment which determines that the material is not flowing through when the amount of light which is received by the light receiving section 300*b* is larger than the threshold which is set in advance and the threshold is set to be smaller as the period of time over which the sheet manufacturing apparatus is used increases. That is, it is possible for the threshold to be appropriately adjusted according to the period of time over which the sheet manufacturing apparatus 1 is used. For example, the threshold St is reduced when there is an increase in the reduction of the received light amount in the light receiving section 300*b* when light is emitted in a state where the material F is not flowing through the sheet manufacturing apparatus 1. Furthermore, the threshold St is reduced in a case where the received light amount in the light receiving section 300*b*, when light is emitted in a state where the material F is not flowing through the sheet manufacturing apparatus 1, is less than the received light amount when starting to use the sheet manufacturing apparatus 1. A detailed method for setting the threshold in the optical detecting unit 300 will be described below.

First, as shown in FIG. 4A, the amount of light which is received by the light receiving section 300*b* in the optical detecting unit 300 is measured in an initial state of the sheet manufacturing apparatus 1. The initial state in this case is a state where, for example, the transparent member 220 of the transfer path 202 is clean. Then, the optical detecting unit 300 is driven in a state where the material F is not flowing through the transfer path 202 in this initial state. Then, light is emitted from the light emitting section 300*a* and a received light amount Lv1, where the emitted light is received by the light receiving section 300*b*, is measured. Then, a threshold St1 is calculated by multiplying a predetermined number m (a coefficient which is less than one (for example, 0.75)) to the received light amount Lv1 which is measured. Then, transferring of the material F (activating of the sheet manufacturing apparatus 1) is started using the threshold St1 which is calculated in the initial state.

Next, the threshold St1 from the initial state is reset as a threshold St2 which is new in a case where the accumulated period of time over which the sheet manufacturing apparatus 1 is used reaches a prescribed period of time. In detail, as shown in FIG. 4B, the amount of light which is received by the light receiving section 300*b* of the optical detecting unit 300 is measured at a point in time where the accumulated period of time over which the sheet manufacturing apparatus 1 is used reaches a prescribed period of time. Specifically, the optical detecting unit 300 is driven in a state where the material F is not flowing through the transfer path 202 at a point in time when the accumulated period of time over which the sheet manufacturing apparatus 1 is used reaches a prescribed period of time. Then, light is emitted from the light emitting section 300*a* and a received light amount Lv2 where the emitted light is received by the light receiving section 300*b* is measured. Then, the threshold St2 is calculated by multiplying the predetermined number m (a coefficient which is less than one) to the received light amount Lv2 which is measured. Here, the predetermined number m which is used to calculate the threshold St1 and the threshold St2 is the same value in the present embodiment. Then, transferring of the material F (activating of the sheet manufacturing apparatus 1) is started using the threshold St2 which is newly calculated. Here, in the present embodiment, the threshold St2 is calculated by multiplying a predetermined number (a coefficient which is less than one) to the received light amount Lv2 which is measured.

Here, as shown in FIG. 4A and FIG. 4B, there is a tendency for the received light amount Lv2, which is in a state where the accumulated period of time over which the sheet manufacturing apparatus 1 is used reaches a prescribed period of time, to be lower than the received light amount Lv1 from the initial state. This is thought to be because a portion of the material F becomes attached to the transparent member 220 of the transfer path 220 or the transparent member 220 is damaged and the transmissivity of light passing through the transparent member 220 is reduced along with elapsing of the accumulated period of time over which the sheet manufacturing apparatus 1 is used. In this case, it is determined that the material is flowing through the transfer path 202 even in a case where the material is not flowing through the transfer path 202 (the transparent section 220) since the overall received light amount is reduced in a case where the presence or absence of the material F is detecting using the threshold St1 irrespective of the received light amount being reduced from the received light amount Lv1 from the initial state to the received light amount Lv2. Therefore, it is possible to correctly perform determining the presence or absence of the material F by the threshold St is reset again, or in more detail, by changing the threshold St1 to the threshold St2 which corresponds to the received light amount Lv2 in a case where the accumulated period of time over which the sheet manufacturing apparatus 1 is used reaches a prescribed period of time.

Here, as the method for setting the threshold St, the threshold St may be set based on the received light amount Lv when the material F is not flowing through the transfer path 202 in cases other than when the accumulated period of time over which the sheet manufacturing apparatus 1 is used reaches a prescribed period of time. In this case, for example, the received light amount Lv2 where the emitted light is received by the light receiving section 300*b* of the optical detecting unit 300 is measured each time a predetermined period of time elapses and the threshold St2 is calculated by multiplying the predetermined number m (a coefficient which is less than one) to the received light amount Lv2 which is measured. Even doing this, it is possible to appropriately set the threshold St according to a received light amount L which changes depending on the period of time over which the sheet manufacturing apparatus 1 is used. By doing this, the threshold St is reduced when there is an increase in the reduction of the received light amount in the light receiving section 300*b* when light is emitted in a state where the material F is not flowing through the sheet manufacturing apparatus 1.

Furthermore, as another method for resetting the threshold St, the threshold St may be set based on, for example, the accumulated raw material which is fed into the sheet manufacturing apparatus 1. In this case, for example, the accumulated number of sheets of the used paper Pu which is the raw material which are fed into the sheet manufacturing apparatus 1 is counted. Then, the received light amount Lv2 where the emitted light is received by the light receiving section 300*b* of the optical detecting unit 300 is measured each time the accumulated number of sheets of the used paper Pu which are fed in reaches a predetermined number of sheets and the threshold St2 is calculated by multiplying the predetermined number m (a coefficient which is less than one) to the received light amount Lv2 which is measured. Even doing this, it is possible to appropriately set the threshold St according to the received light amount L, which changes depending on the amount of raw material which is fed in, in accordance with the period of time over which the sheet manufacturing apparatus 1 is used.

According to the present embodiment described above, it is possible to obtain the following effects.

The transfer path 202 has the curved sections 210*a* and 210*b* and the optical detecting unit 300 is provided in the linear sections 211*a* and 211*b* after the curved sections 210*a* and 210*b* in the transfer direction of the material F. The material F which is being transferred in the transfer path 202 is transferred to be drawn together at the one side of the linear section 211*a* side of the transfer path 202 due to centrifugal force after the curved sections in the transfer direction of the material F. For this reason, it is possible to easily detect the presence or absence of the material F using the optical detecting unit 300. Then, based on the detecting, it is possible to easily manage the transfer amount of the material F.

As shown in FIG. 2B, the material F is in an amount to the extent of only being in a small portion of the cross section of the transfer path 202. For this reason, there is a high possibility that the material F will not reach to one optical axis and it is not possible to detect that there is the material when the material F is scattered over the entire cross section of the transfer path 202 in a case where an optical detecting unit is arranged in the curved sections 219*a* and 219*b*. For this reason, it is necessary for a plurality of the detecting units to be arranged so that optical axes reach the entire cross section of the transfer path 202. On the other hand, due to the material F being drawn together due to centrifugal force in the present embodiment, it is possible to collect a small amount of the material in one location and it is possible to easily detect the presence or absence of the material. In addition, due to the material being collected in one location, using a plurality of the optical axes S is no longer necessary and a plurality of the detecting units need not be used. Detecting is possible in the present embodiment described above using one of the detecting units. Here, there may be a small number such as 2 or 3 of the detecting units and the detecting units may be arranged in a portion where the material is drawn together. This is an effective means in a case where the material F is transfer in air.

In addition, the present embodiment described above is particularly effective in a case of manufacturing paper which is thinner than a nonwoven material. The effect on strength due to variation in the amount of fibers which are used in paper is larger than for nonwoven materials. For this reason, it is more imperative that the transfer amount of fibers be managed for paper than for nonwoven materials. Here, the present embodiment described above may be used in manufacturing nonwoven materials since it is possible to also detect a state where the material to be defibrated Pu is not being supplied.

The threshold St1, which is set to correspond to the received light amount Lv1, is reevaluated and is reset to the threshold St2, which corresponds to the received light amount Lv2 in a case where the received light amount Lv1 changes to the received light amount Lv2 in accordance with the period of time over which the sheet manufacturing apparatus 1 is used. Due to this, since the threshold St is appropriately adjusted in accordance with the accumulated period of time over which the sheet manufacturing apparatus 1 is used, it is possible to appropriately maintain the detection accuracy of the optical detecting unit 300 and reduce measurement errors in detection of the transfer weight of the defibrated material.

The present invention is not limited to the embodiment described above and various modifications and alterations may be added to the embodiment described above. Modified examples are described below.

Modified Example 1

Figure 5A:
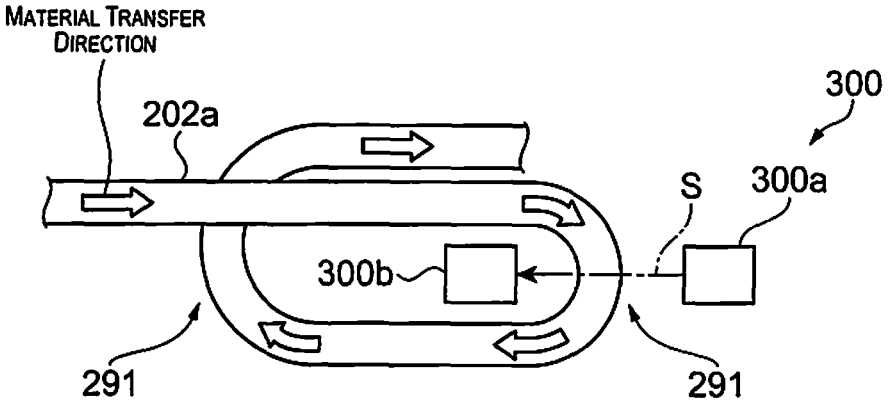
FIGS. 5A and 5B are configuration diagrams illustrating a configuration of an optical detecting unit and peripheral units in a modified example.
Figure 5B:
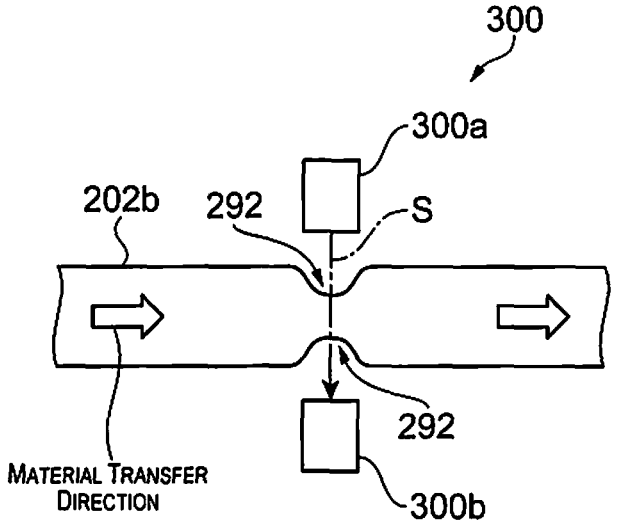

There is a configuration in the embodiment described above where the curved sections 210 of the transfer path 202 are curved by approximately 90 degrees with regard to the horizontal sections 219*a* and 219*b* but the configuration is not limited to this. FIGS. 5A and 5B are configuration diagrams illustrating a configuration of an optical detecting unit and peripheral units in a modified example. As shown in FIG. 5A, a transfer path 202*a* has a spiral shape. Then, there is a curved section 291 which is curved by 180 degrees or more in an intermediate portion of the transfer path 202*a*. Then, the optical detecting unit 300 is arranged at a position which corresponds to the curved section 291. Even doing this, it is possible to detect the presence or absence of the material since the material is drawn together at one side of the curved section 291 using a flow of air. In addition, as shown in FIG. 5B, there is an indented section 292 as a curved section in an intermediate portion of a transfer path 202*b*. Then, the optical detecting unit 300 is arranged at a position which corresponds to the indented section 292. It is possible to detect the presence or absence of the material since the material is drawn together at the indented section 292 using a flow of air even if the cross section of the transfer path is restricted. That is, it is sufficient to detect where the material is drawn together even without using centrifugal force.

Modified Example 2

The optical detecting unit 300 is arranged in the transfer path 202 in the present embodiment but the configuration is not limited to this. For example, the optical detecting unit 300 may be arranged in the transfer path 203, the transfer path 204, or the like. In FIG. 1, the transfer path 203 and the transfer path 204 may also have curved sections and the optical detecting unit 300 may be provided at the curved sections or on the downstream side of the curved sections. By doing this, in a case where, for example, the optical detecting unit 300 is arranged in the transfer path 203, it is possible to detect the presence or absence of the classified material and to manage the transfer weight of the classified material. In addition, in a case where the optical detecting unit 300 is arranged in the transfer path 204, it is possible to detect the presence or absence of the screened material and to manage the transfer weight of the screened material. Here, it is not problematic if the direction in which the curved sections are curved is any direction in a case where centrifugal force due to a flow of air is used. In the case of using gravity, since it is desirable that the transfer path on the upstream side of the curved sections is downward in the vertical direction, the transfer path 202 is not desirable and the transfer path 203 and the transfer path 204 are desirable. Furthermore, the threshold St is appropriately rest in accordance with the accumulated period of time over which the sheet manufacturing apparatus 1 is used in the respective optical detecting units 300 which are arranged in the transfer path 203, the transfer path 204, and the like. By doing this, it is possible to obtain the same effects as the effects of the embodiment described above.

Modified Example 3

The presence or absence of the material is detected in the transferring of the defibrated material as the material in the embodiment described above but the configuration is not limited to this. There is no particular limitation as long as the material is at least a portion is the material for sheets. For example, the material may include only fibers, only resin, or other substances. Even doing this, it is possible to detect the presence or absence of the material to be transferred.

Modified Example 4

The optical detecting unit 300 is arranged at a position which corresponds to the linear section 211*a* and 211*b* which are on the downstream side of the curved sections after the curved sections 210 and beyond in the transfer direction of the material F in the embodiment described above but the configuration is not limited to this. For example, the optical detecting unit 300 may be arranged at a position which corresponds to the curved sections 210. From the curved sections 210 and beyond includes the curved sections and the transfer path on the downstream side of the curved sections in the transfer direction of the material F. Even with this, it is possible to detect the presence or absence of the material F since the material F is drawn together at one side of the curved section 210*a* of the curved sections 210 due to a flow of air in the curved sections 210.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A sheet manufacturing apparatus comprising:

a transfer part through which flows, in air, at least a portion of a material for a sheet, the transfer part having a curved section where the transfer part is curved, and a downstream section arranged downstream relative to the curved section and upstream relative to a most downstream end of the transfer part in a transfer direction in which the material is transferred;

a forming unit configured to form the sheet using the material and arranged downstream relative to the transfer part in the transfer direction; and an optical detecting unit configured to detect the material and arranged at one of the curved section and the downstream section, the one at which the optical detecting unit is arranged including a transparent portion through which light is transmitted.

2. The sheet manufacturing apparatus according to claim 1, wherein light which is emitted from the optical detecting unit is transmitted through at least a portion of the transparent portion.

3. The sheet manufacturing apparatus according to claim 1, further comprising a defibrating unit configured to defibrate at least a portion of the material, and an accumulating unit configured to accumulate the material, the transfer part being downstream of the defibrating unit in the transfer direction and being upstream of the accumulating unit in the transfer direction.

4. The sheet manufacturing apparatus according to claim 1, wherein the transfer part has linear sections on both sides of the curved section, and an opening angle of the linear sections is 45 degrees or more and 150 degrees or less.

5. The sheet manufacturing apparatus according to claim 1, wherein the optical detecting unit includes a light emitting section configured to emit the light with regard to the transparent portion and a light receiving section configured to receive the light which passes through the transparent portion, and the sheet manufacturing apparatus further comprises a control section configured to determine that the material is not flowing through when an amount of the light which is received by the light receiving section is larger than a threshold which is set in advance, and the threshold is reduced as an accumulated period of time over which the sheet manufacturing apparatus is used increases.

6. The sheet manufacturing apparatus according to claim 5, wherein the control section is configured to reduce the threshold in a case where a received light amount in the light receiving section, when the light is emitted in a state where the material is not flowing through the sheet manufacturing apparatus, is a first value, as compared with in a case where the received light amount in the light receiving section when the light is emitted in the state is a second value, which is larger than the first value.

7. The sheet manufacturing apparatus according to claim 5, wherein the control section is configured to reduce the threshold in a case where the received light amount in the light receiving section, when the light is emitted in a state where the material is not flowing through the sheet manufacturing apparatus, is smaller than the received light amount when starting to use the sheet manufacturing apparatus.

8. A sheet manufacturing method comprising:

flowing at least a portion of a material for a sheet in a transfer part which has a curved section and a downstream section that is arranged downstream relative to the curved section and upstream relative to a most downstream end of the transfer part in a transfer direction in which the material is transferred;

detecting the material using an optical detecting unit which is arranged at one of the curved section and the downstream section, the one at which the optical detecting unit is arranged including a transparent portion through which light is transmitted; and forming a sheet using the material.

9. A sheet manufacturing method for manufacturing a sheet using a sheet manufacturing apparatus, which includes a transfer part through which flows, in air, at least a portion of a material for the sheet, and a forming unit arranged downstream relative to the transfer part in a transfer direction in which the material is transferred, the forming unit being configured to form the sheet using the material, the transfer part having a transparent section through which light is transmitted and an optical detecting unit having a light emitting section which is configured to emit the light with regard to the transparent section and a light receiving section which is configured to receive the light which passes through the transparent section, the method comprising:

forming a sheet using the material; and reducing a threshold as an accumulated period of time over which the sheet manufacturing apparatus is used increases, in a case of determining that the material is not flowing through when an amount of the light which is received at the light receiving section is larger than the threshold which is set in advance.

* * * * *